United States Patent [19]

Tani et al.

[11] Patent Number: 4,977,429

[45] Date of Patent: Dec. 11, 1990

[54] APPARATUS FOR SUPPLYING TONER TO AN IMAGE FORMING APPARATUS

[75] Inventors: Tatsuo Tani, Urayasu; Mutsuo Watanabe, Yokohama, both of Japan

[73] Assignee: Ricoh Company, Ltd., Tokyo, Japan

[21] Appl. No.: 430,576

[22] Filed: Nov. 1, 1989

[30] Foreign Application Priority Data

Nov. 8, 1988 [JP] Japan ..... 63-280528

[51] Int. Cl.[5] ..... G03G 15/06; G03G 21/00

[52] U.S. Cl. ..... 355/260; 355/206

[58] Field of Search ..... 355/260, 204, 206, 208, 355/209, 245, 246, 200; 222/DIG. 1

[56] References Cited

U.S. PATENT DOCUMENTS 4,629,309 12/1986 Tsukano et al. ..... 355/245
4,682,158 7/1987 Ito et al. ..... 355/209 X

FOREIGN PATENT DOCUMENTS 0073638 6/1979 Japan ..... 355/208
0235174 11/1985 Japan ..... 355/208
0137170 6/1986 Japan ..... 355/208

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

An image forming apparatus having a developing unit for developing a latent image electrostatically formed on a photoconductive element or similar image carrier by a developer, or toner, to produce a toner image, and a cartridge removably mounted on the apparatus for supplying a toner thereto. An operator is directed through the steps of toner re-supply from the removal of the used toner cartridge to the insertion of a new toner cartridge while watching instructions which sequentially appear on a display. The present invention allows for the display of instructions which will lead the operator applyin toner through a step-by-step process to ensure that the toner is added correctly, quickly and efficiently.

4 Claims, 11 Drawing Sheets

APPARATUS FOR SUPPLYING TONER TO AN IMAGE FORMING APPARATUS

BACKGROUND OF THE INVENTION

The present invention relates to an image forming apparatus of the type having a developing unit for developing a latent image electrostatically formed on a photoconductive element or similar image carrier by using a developer, or toner, and using a toner cartridge which is filled with a toner and loaded in the developing unit. The present invention also relates to an improvement in the toner cartridge applicable to such an apparatus.

In an image forming apparatus of the type described which may be implemented as an electrophotographic copier, printer or facsimile machine, for example, a toner stored in a developing unit is consumed every time an image is formed and, in due course, the toner supply becomes short. A toner cartridge filled with a toner has customarily been loaded in the developing unit in order to supply the toner as needed. To promote accurate manipulations for such a toner supply, the image forming apparatus is usually constructed to sense the short supply of toner in the developing unit and display the shortage on a display, thereby urging one to supply a more toner. Specifically, one is urged to remove the used toner cartridge and then load a fresh toner cartridge in the developing unit.

The prior art apparatus, however, provides no visible instructions as to what the operator is expected to execute after dismounting the used toner cartridge or after mounting a fresh toner cartridge. This often perplexes the operator concerning the kind of work which should be done after the removal or insertion of a toner cartridge. Moreover, it may occur that after mounting a fresh toner by a troublesome manipulation one forgets an expected manipulation for feeding the toner to the developing unit, i.e., the image forming operation continues without the toner being supplied at all.

SUMMARY OF THE INVENTION

It is therefore an object of the present invention to provide an image forming apparatus which allows any one to execute a toner supplying sequence without fail, and a toner cartridge therefor.

It is another object of the present invention to provide a generally improved image forming apparatus and a toner cartridge therefor.

In accordance with the present invention, an image forming apparatus for developing a latent image electrostatically formed on an image carrier by a developer in the form of a toner to produce a toner image comprises a developing device loaded with a removable toner cartridge containing a toner therein and supplied with the toner from the toner cartridge, a sensing device responsive to a condition wherein the toner should be supplied to the developing device and to execution of consecutive manipulations for toner supply, and a display for displaying, in response to an output signal of the sensing device, a kind of manipulation to be executed next.

Further, in accordance with the present invention, a toner cartridge removably mounted on an image forming apparatus which develops a latent image electrostatically formed on an image carrier by a developer in the form of a toner for supplying the toner to the apparatus comprises a body accommodating the toner, a shutter openably mounted on an opening which is formed through the body, and an actuator provided on the shutter for actuating a shutter sensor which is mounted on the image forming apparatus for sensing opening of the shutter.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
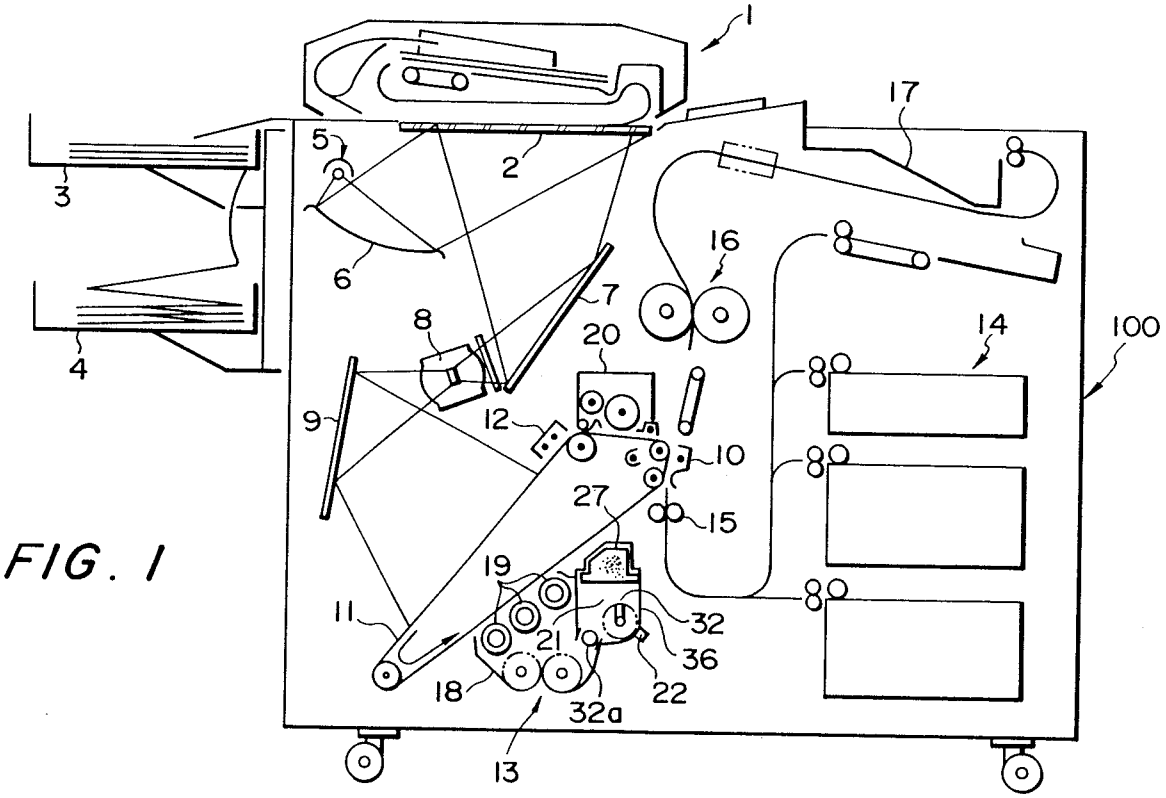
FIG. 1 is a sectional side elevation schematically showing an image forming apparatus embodying the present invention which is implemented as a copier.

Referring to FIG. 1 of the drawings, an image forming apparatus embodying the present invention is shown which is implemented as an electrophotographic copier, by way of example. As shown, the copier has a copier body 100 and an ADF (Automatic Document Feeder) 1 which is mounted on the top of the copier body 100. The ADF 1 feeds sheet documents, print-out paper for computer use or similar documents toward a glass platen 2 one by one. Each document reaching the glass platen 2 is driven thereoutof to be returned to the ADF 1 or to be discharged onto either one of trays 3 and 4. On reaching the glass platen 2, the document is instantly illuminated by a light source 5 over its entire surface through a mirror 6. A reflection from the document is steered by a mirror 7, a lens 8 and a mirror 9 to be focused onto a photoconductive element 11. The photoconductive element in the form of a belt 11 is driven in a direction indicated by an arrow in the FIG. 1. The belt 11 is uniformly charged by a main charger 12 before the above-mentioned exposure to the reflection of the document, so that an electrostatic latent image is formed on the belt 11 by the imagewise exposure. A developing unit 13 develops the latent image on the belt 11 by a toner. A transfer charger 10 transfers by corona discharge the resulting toner image from the belt 11 to a paper sheet which is fed from a sheet feed section 14 via a register roller pair 15. The paper sheet undergoing the image transfer is transported through a fixing unit 16 to a tray 17 provided on the top of the copier body 100. After the image transfer, the surface of the belt 11 is cleaned by a cleaning unit 20 to remove remaining toner particles and impurities.

Figure 4:
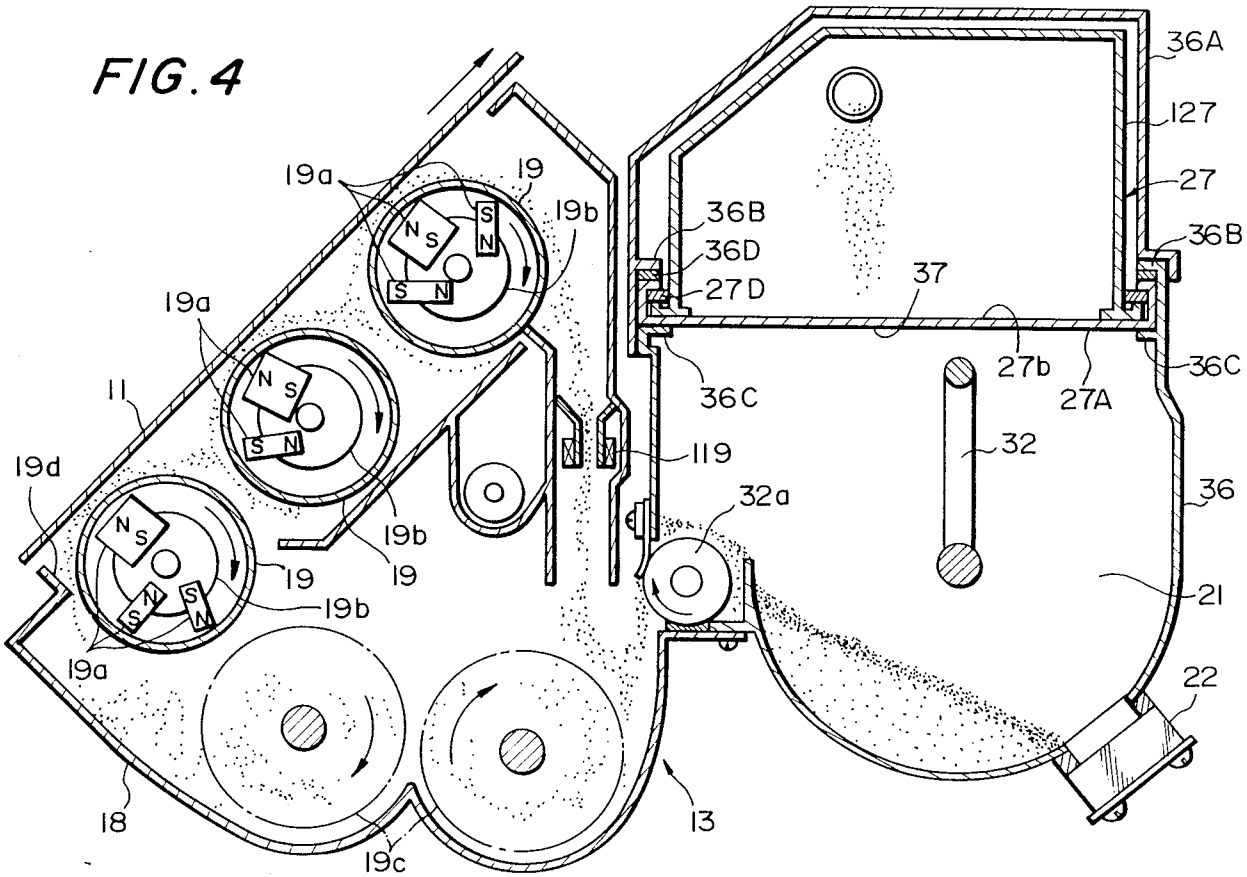
FIG. 4 is a sectional side elevation of a developing unit installed in the copier.

As best shown in FIG. 4, the developing unit 13 has a suitable number of, three in the illustrative embodiment, developing rollers 19 which face the belt 11, and a developer container 18 which is loaded with a powdery two-component developer. A two-component developer is the combination of toner and carrier, as is well known in the art. Magnets 19*a* are disposed in each roller 19 and rigidly mounted on a holder 19*b*. The carrier is made of a magnetic material, while the developing rollers 19 are made of a non-magnetic material. The developing rollers 19 are individually rotatable clockwise as viewed in FIG. 4. Paddle wheels 19*c* are accommodated in the developer container 18 for agitating the developer. The leftmost developing roller 19 as viewed in FIG. 4 scoops up the developer and, in cooperation with its associated magnets 19*a*, conveys it. A doctor blade 19*d* regulates the thickness of the developer being so transported by the developing roller 10. The developer on the leftmost developing roller 19 is handed over to the next or intermediate developing roller 19 and further to the rightmost developing roller 19. The rightmost developing roller 19 lets the developer drop into the bottom portion of the developer container 18. While the developer is sequentially transported by the developing rollers 19, it is deposited on the latent image on the belt 11 to turn it into a toner image.

Figure 10:
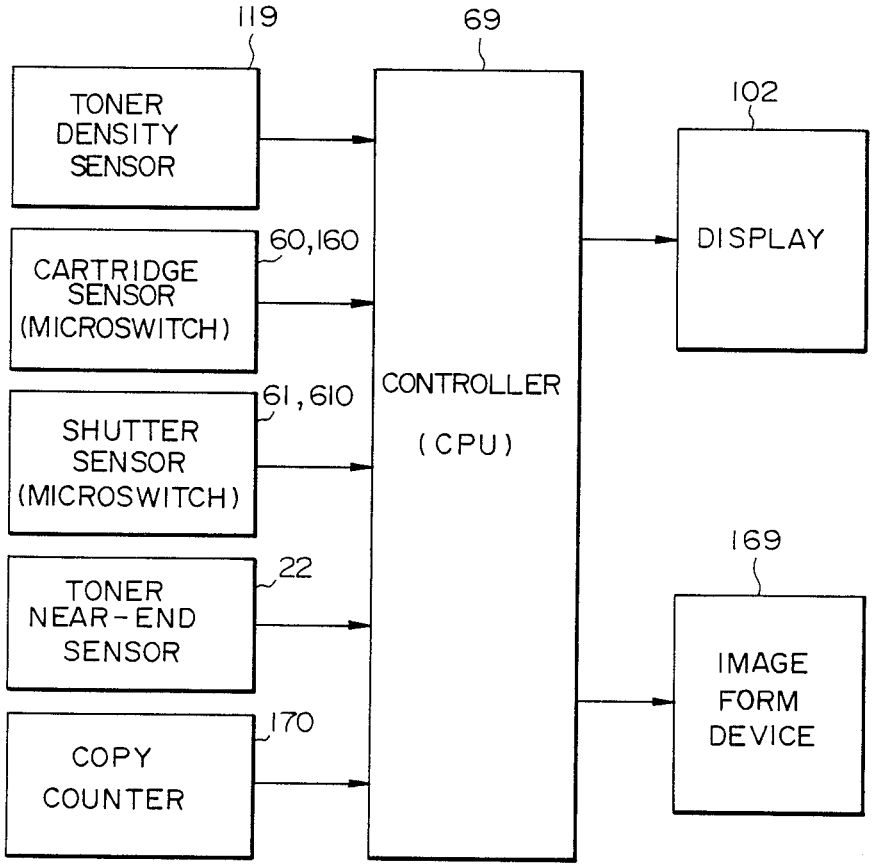
FIG. 10 is a schematic block diagram showing specific control circuitry for controlling the illustrative embodiment.

A toner density sensor 119 is disposed on the above-stated toner transport path for sensing the density of the toner being used to develop a latent image. As the development is repeated, the toner stored in the developer container 18 is sequentially consumed resulting in the toner concentration of the developer being lowered little by little. The decrease in toner density would lower the quality of toner images. In light of this, the developing unit 13 has a toner hopper 36 which defines a toner supply chamber 21. When the toner density sensor 119 detects a decrease in the toner concentration of the developer, its output causes a toner supply roller 32*a* into rotation so as to feed the toner from the toner supply chamber 21 into the developer container 18. This maintains the toner concentration of the developer in the container 18 at a predetermined range. FIG. 10 shows specific control circuitry applicable to the illustrative embodiment. As shown, the toner density sensor 119 feeds its output or toner density signal to a controller 69 which is constituted by a CPU (Central Processing Unit). In response, the controller 69 drives the toner supply roller 32*a* of the developing unit 13 which forms a part of an image forming apparatus 169.

The toner is comprised of toner particles with or without an adjuvant being added thereto.

Figure 2:
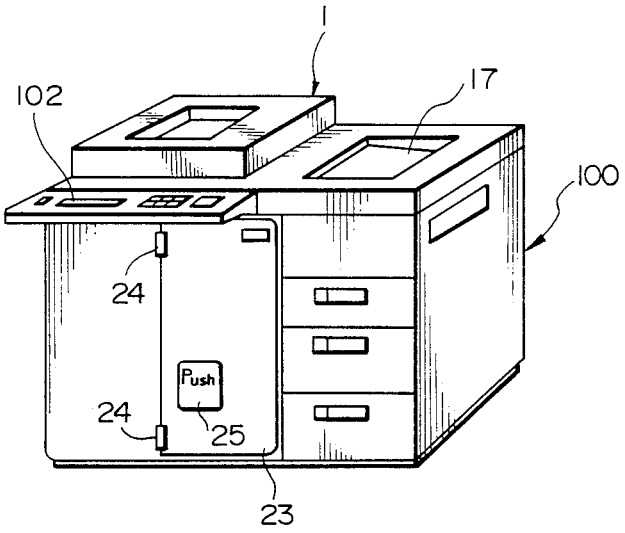
FIG. 2 is a perspective view of the copier shown in FIG. 1.

A toner near-end sensor 22 is located in close proximity to the bottom of the toner supply chamber 21 and constitutes a specific form of a toner shortage sensor. When the amount of toner remaining in the toner supply chamber 21 decreases beyond a predetermined amount, the toner near-end sensor 22 detects it and produces a toner near-end signal. While the sensor 22 may be implemented as a piezoelectric sensor or a transmission type optical sensor, a piezoelectric sensor is used in the illustrative embodiment. A piezoelectric sensor allows the varying amount of toner to be detected in terms of its oscillation frequency which varies with the amount of toner that faces the sensor. Advantageously, two or more sensors 22, e.g., two sensors 22 may be arranged in parallel to reduce the down time of the apparatus which is ascribable to any failure thereof. A display 102, FIG. 2, is mounted on the top front portion of the copier body 100. In response to the toner near-end signal from the near-end sensor 22, the display 102 provides a message such as "SUPPLY TONER" thereon. This display is effected by the cooperation of the toner near-end sensor 22 and a cartridge sensor which will be described.

When a predetermined number of more copies (e.g. 3,000 more copies) are produced without supplying toner after the appearance of the above message on the display 102, a toner end signal will be produced to disable the entire apparatus while showing a particular message on the display 102. In the illustrative embodiment, therefore, even if one does not supply the toner at the instant when the near-end message appears, a predetermined number of more copies can be produced by the remaining toner. If desired, an arrangement may be so made as to output the toner end signal when the toner density remains lowered throughout such an extra number of copying operations and does not increase. In any case, the copier is operable without the supply of toner after the message for urging one to supply toner has appeared.

Figure 6:
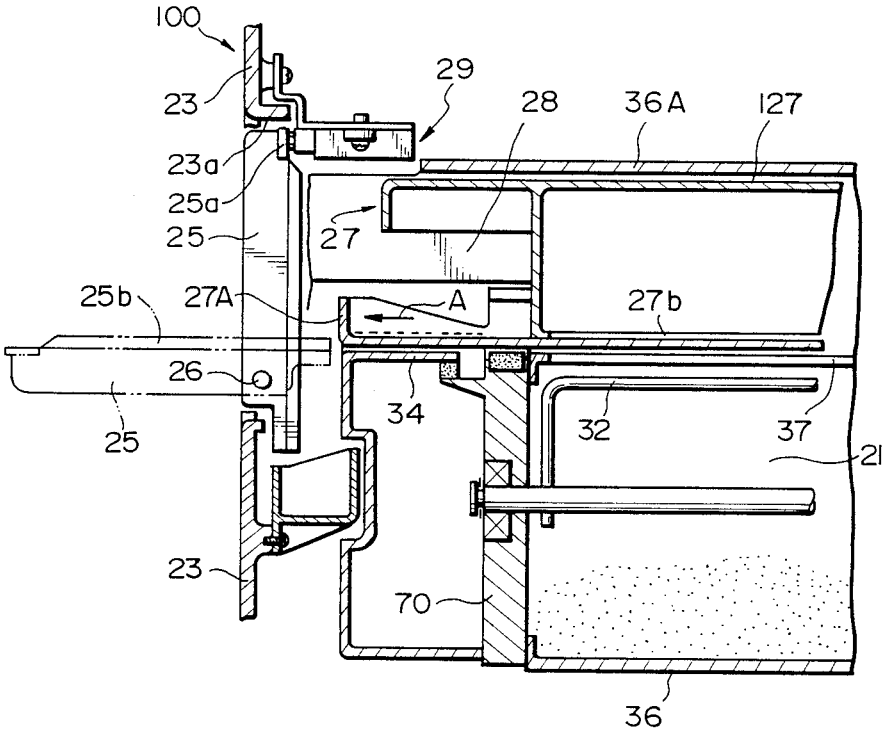
FIG. 6 is a sectional side elevation of an arrangement around the toner cartridge inlet portion, in which a microswitch constituting a shutter sensor and its associated construction are omitted.

Referring to FIG. 2, the copier body 100 has a door cover 23 at the front end thereof which is openable about hinges 24. A lid 25 is openably mounted on the door cover 23 to facilitate the removal of a jamming sheet and other manipulations. A projection, not shown, extends from the inner wall of the door cover 23, while an interlock switch, not shown, is affixed to the copier body 100. When the door cover 23 is opened, the projection will actuate the interlock switch into an OFF state to interrupt the image forming operation, i.e., the copying operation of the copier. This is successful in insuring safety operations while the door cover 23 is open. Conversely, when the door cover 23 is closed, the projection will turn the interlock switch to an ON state to resume the copying operation. As shown in FIG. 6, the lid 25 is rotatably connected to the door cover 23 by a shaft 26.

Figure 5:
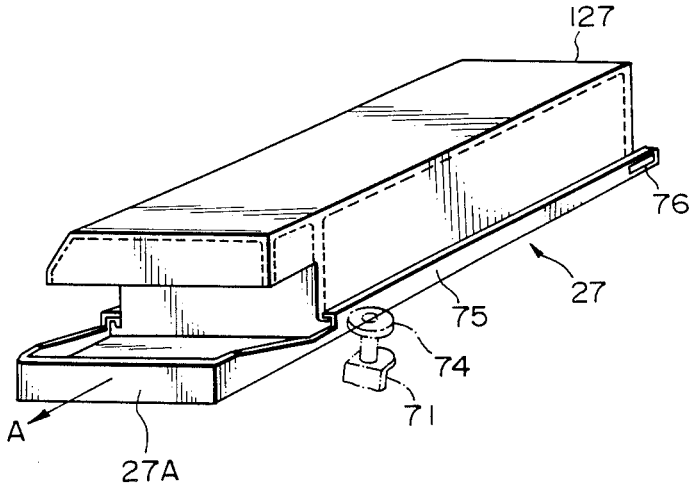
FIG. 5 is a perspective view of a toner cartridge of the illustrative embodiment.

Referring to FIG. 5, a toner cartridge 27 is shown as comprising a body 127 and a shutter 27A which openably closes an opening 27*b*, FIGS. 4 and 6, that is formed through the bottom of the body 127. The toner cartridge 27 is filled with a toner to be supplied. In the illustrative embodiment, the shutter 27A is implemented as a lid which is supported by the body 127 in such a manner as to slide in a direction indicated by an arrow A in FIG. 5. When the slidable shutter 27A is pulled out in the direction A, it uncovers the opening 27*b* of the body 127. Labeled 27D in FIG. 4 is a seal member affixed to the body 127 for providing seal between the body 127 an the shutter 27A. In FIGS. 4 and 6, the toner cartridge 27 is shown in an operative position.

Figure 3:
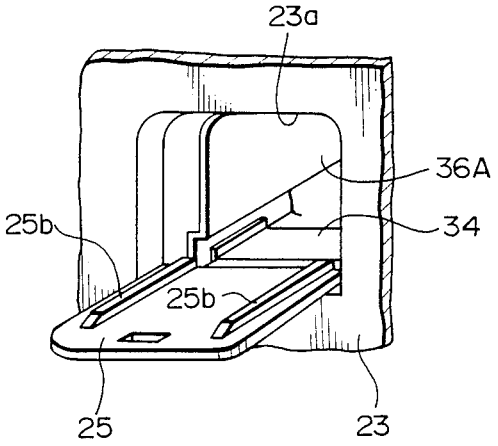
FIG. 3 is a perspective view of a lid which is mounted on a door cover of the copier and an internal arrangement of a toner cartridge inlet portion which is uncovered by the lid.

As shown in FIG. 3, the door cover 23 has an opening 23*a* which is accessible for mounting and dismounting the toner cartridge 27. As shown in FIG. 6, a bore 28 is defined above the toner supply chamber 21 to communicate with the opening 23*a*. A lid 25 is movable to block and unblock the opening 23*a*, i.e. the bore 28. A magnetic member 25*a* is affixed to the free end of the lid 25, while a so-called push-push type magnetic catch 29 is mounted on the copier body 100 for attracting the magnetic member 25*a*. This allows the lid 25 to be held in either one of its open and closed positions as needed. For example, the lid 25 will open when pushed once and will close when pushed again. In any case, in the event of replacement of the toner cartridge, the lid 25 is pulled down from an upright position indicated by a slid line in FIG. 6 to a horizontal position indicated by a phantom line position (position shown in FIG. 3), thereby uncovering the opening 23*a*.

When the toner near-end sensor 22, FIG. 4, detects a toner near-end state, the display 102 shows "SUPPLY TONER" or a similar message thereon as previously stated and as will be described in detail later. Urged by the message on the display 102, the operator or the serviceman pulls down the lid 25 to the horizontal position as mentioned in order to replace the toner cartridge. Then, the operator or the serviceman pulls out the empty toner cartridge 27 out of the bore 28, i.e. to the left as indicated by an arrow A in FIG. 6. It is noteworthy that the illustrative embodiment allows the image forming operation, e.g., the copying operation to be continued without interruption even during the replacement of the toner cartridge 27. Specifically, while the door cover 23 is provided with an interlocking device, the lid 25 is not and, hence, does not disturb the image forming operation under way even when it is opened.

A cartridge cover 36A is formed integrally with the toner hopper and has the bore or cartridge mounting and dismounting path 28 thereinside. After the empty toner cartridge 27 has been removed through the opening 23*a*, a fresh toner cartridge 27 is inserted into the bore 28 through the opening 23*a* in the opposite direction to the direction A while being guided by the horizontal lid 25 and an inner cover 34 which is affixed to the toner hopper 36. The toner cartridge 27 is then positioned above the toner hopper 36. As shown in FIG. 4, the new toner cartridge 27 is also guided by guides 36B and 36C which form a part of either one of the cartridge cover 36A and toner hopper 36. In FIG. 4, labeled 36D is a seal member associated with the guide 36B for providing a seal between the guide member 36B and the shutter 27A. Two ridges 25*b*, FIG. 3, are provided on the inner surface of the lid 25 to further facilitate the movement of the toner cartridge 27 into and out of the bore 28, i.e., the lid 25 plays the role of a guide in addition to its original role. For this purpose, the lid 25 is hinged at its lower end. Of course, one may open the door cover 23 and then mount or dismount the toner cartridge 27 by using the inner cover 34 as a guide.

Figure 7:
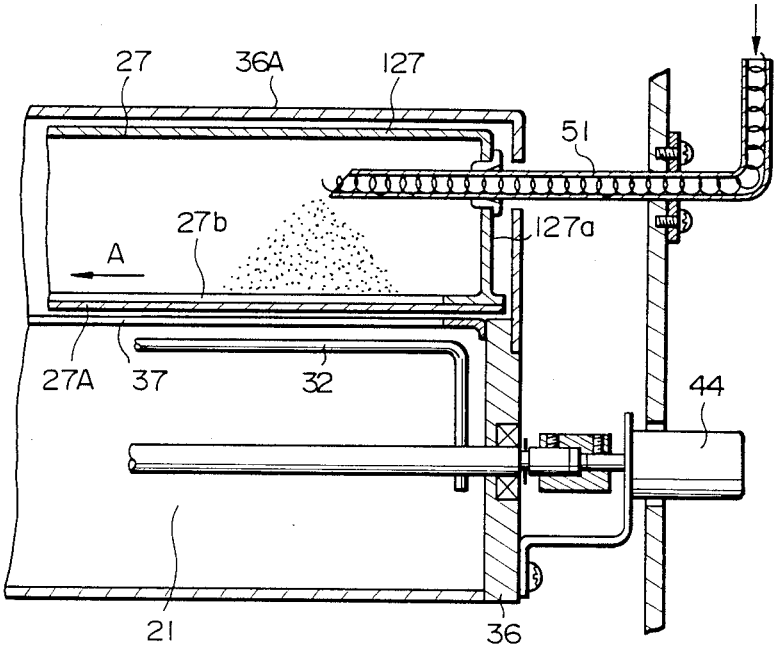
FIG. 7 is a sectional side elevation showing an arrangement provided in the innermost part of the copier with respect to an intended direction of cartridge insertion.

The toner cartridge 27 has the shutter 27A at its bottom, as previously stated. After a new toner cartridge 27 has been positioned as shown in FIGS. 6 and 7, the shutter 27A is pulled out in the direction A with the cartridge body 127 being left in the bore 28. At the time when the shutter 27A abuts against a stop, not shown, which is provided on the body 127, the opening 27*b* at the bottom of the body 127 is fully uncovered. If desired, an arrangement may be made such that the shutter 27A being pulled in the direction A removes a seal which is adhered to the bottom of the cartridge 27, thereby automatically uncovering the opening 27*b*. When the opening 27*b* is uncovered, fresh toner is dropped from the toner cartridge 27 into the toner supply chamber 21 through an opening 37 which is formed through the top of the toner hopper 36. The toner supply chamber 21 has an agitating member 32 thereinside. Supplied with the fresh toner, the copier is operable for a long period of time thereafter. The agitating member 32 is driven in a rotary motion by a motor 44, FIG. 7, to agitate the toner in the toner supply chamber 21 while feeding the toner toward a toner supply roller 32. After the supply of toner, the shutter 27A of the toner cartridge 27 is pushed into the copier to the original position, and then the lid 25 is closed.

As stated above, the toner cartridge 27 can be replaced simply by opening the lid 25 which is void of an interlocking device and, therefore, without interrupting the copying operation under way. This further increases the productivity of the copier.

The cleaning device 20 shown in FIG. 1 removes remaining toner particles from the surface of the photoconductive belt 11, as stated earlier. If an arrangement is so made as to collect the removed toner or waste toner in the toner cartridge 27 which has been emptied, the need for an exclusive receptacle will be eliminated. As shown in FIG. 7, in the illustrative embodiment, a toner discharge conduit 51 is configured such that its end enters the toner cartridge 27 when the latter is inserted into the copier. In this condition, the shutter 27A of the cartridge 27 is pulled out to let a fresh toner to drop and, after the cartridge 27 has been emptied, the shutter 27A is closed again. Then, the cartridge 27 is ready to receive the waste toner from the cleaning device 20 therein. In the event of replacement of the cartridge 27 with a new cartridge, the collected waste toner will be discarded together with the used cartridge 27. Should the waste toner be collected in an exclusive receptacle, an extra and troublesome operation would be needed to replace the receptacle after the replacement of the cartridge 27.

A problem with a prior art electrophotographic copier of the type described is that after the removal of the used toner cartridge 27 or the insertion of a new toner cartridge the copier does not indicate on a display thereof the kind of work which should be done next. In such a situation, one is apt to continue with the copying operation without the supply of toner despite the fact that he or she has removed the used toner cartridge or inserted a new toner cartridge, forgetting to pull out the shutter, for example. Especially, when the copier, like the copier shown and described, is so constructed as to continue the copying operation even during the time toner is supplied in order to reduce the down time as far as possible, one often forgets to pull out the shutter.

The copier shown and described allows the waste toner to be collected in a toner cartridge, as discussed earlier. Such a configuration needs some implementations against the following occurrences. Specifically, if the copier is continuously operated without a new toner cartridge being loaded after the removal of the used one, the waste toner will be introduced in the toner hopper to smear the background of toner images or to cause scattering of toner particles. When one forgets to pull out the shutter of a new toner cartridge after the insertion of the latter in the copier, the waste toner will be sequentially collected in the new cartridge as the copying operation is continued. Then, the waste toner fills up the cartridge together with the fresh toner and is solidified. Moreover, the waste toner is apt to stuff toner transport devices intervening between the cleaning unit and the toner cartridge to thereby damage such devices. In the worst case, the waste toner will fill up even the entire cleaning unit to cause solidification and overflow of toner as well as to damage the entire cleaning unit and sometimes the photocondutive element.

In the light of the above, the present invention not only urges one to supply a toner to the developing unit 13 but also allows one to execute a sequence of steps for toner supply smoothly. A device is provided for sensing the execution of the individual steps for toner supply, while a display responsive to the outputs of the sensing device notifies the operator of the kind of work which has to be done next.

Figure 8:
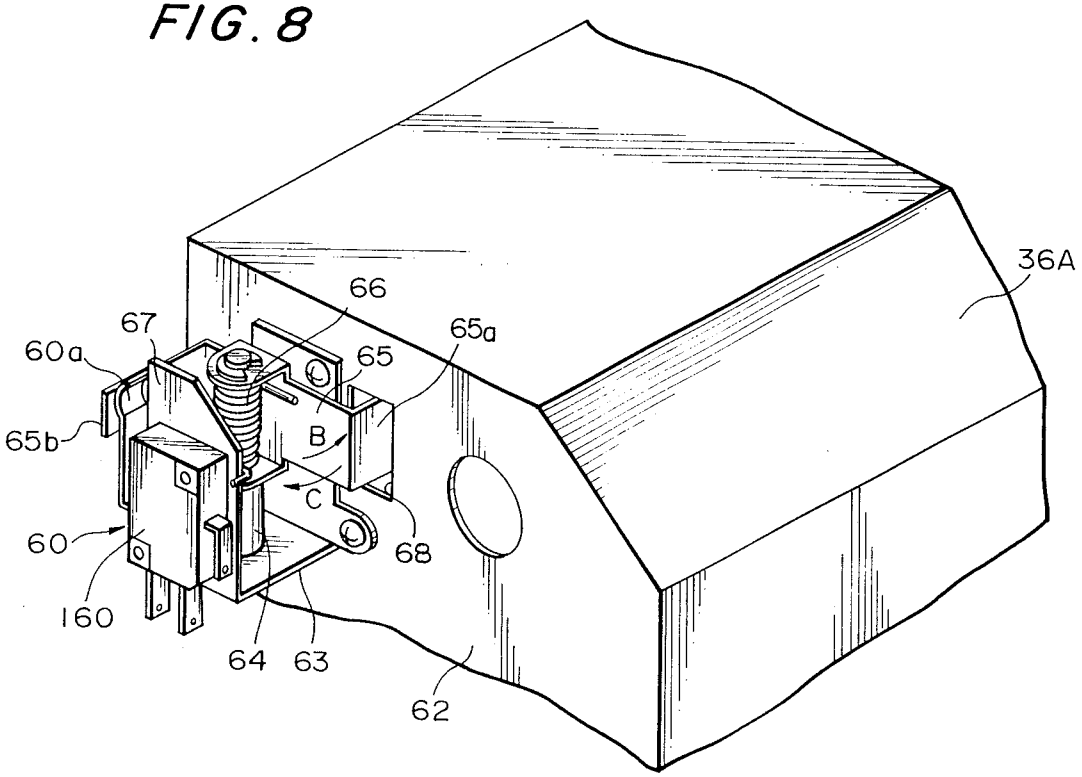
FIG. 8 is a perspective view of a microswitch and its associated arrangement which are provided in the innermost part of a cartridge cover.
Figure 9:
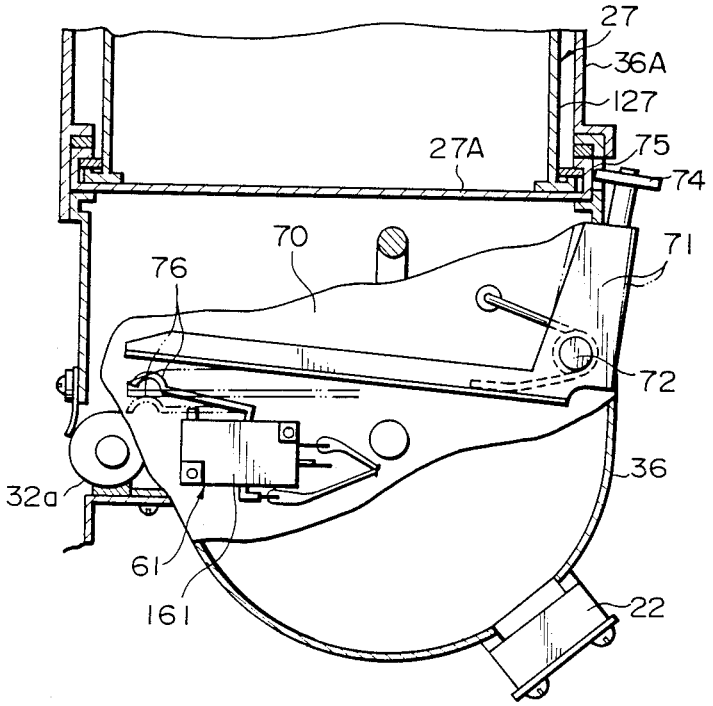
FIG. 9 is a view showing a microswitch and its associated arrangement which are provided in the outermost part of a toner hopper.

In the illustrative embodiment, the above-mentioned sensing device comprises the previously stated toner near-end sensor 22, a cartridge sensor 60, FIG. 8, responsive to the insertion of the toner cartridge 27, and a shutter sensor 61, FIG. 9, responsive to opening of the shutter 27A. The toner near-end sensor 22 and cartridge sensor 60 cooperate to determine that the toner supply is needed, causing the display 102 to show a message for alerting one to such a condition. Since the toner near-end sensor has already been described in detail, the following description will concentrate on a specific construction of the cartridge sensor 60.

Referring to FIG. 8, the cartridge sensor 60 is rigidly mounted on the inner end wall 62 of the cartridge cover 36A by a bracket 63. In the specific construction shown in FIG. 8, the cartridge sensor 60 is implemented by a microswitch 160 having an actuating arm **60*a*. A pin 64 is studded on the bracket 63, while a lever 65 is supported by the pin 64 and rotatable as indicated by arrows B and C in the figure. An opening 68 is formed through the end wall 62 of the cartridge cover 36A, while one end 65*a* of the lever 65 protrudes into the cartridge cover 36A through the opening 68. The other end 65*b* of the lever 65 is engageable with the arm 60*a* of the microswitch 160. A torsion coil spring 66 is wound around the pin 64 and is anchored on one end to the lever 65 and at the other end to the bracket 63. The spring 66, therefore, constantly biases the lever 65 in the direction B. While the toner cartridge 27 is absent in the cartridge cover 36A, the lever 65 is positioned by the spring 66 such that its end 65*b* abuts against a stop 67 which extends out from the bracket 63, as shown in FIG. 8. In this condition, the end 65*b* of the lever 65 presses the arm 60*a* of the microswitch 160 to maintain the switch 160 in an OFF state. Conversely, when the toner cartridge 27 is held in the deepest position within the cartridge cover 36A as shown in FIGS. 6 and 7, the inner end wall 127*a*, FIG. 7, of the cartridge body 127 presses the lever 65 in the direction C against the force of the spring 66. The end 65*b* of the lever 65, therefore, is spaced apart from the arm 60*a* of the microswitch 160 maintaining the switch 160 in an ON state. This state of the switch 160 is representative of the presence of the toner cartridge 27**.

Assume that the toner near-end sensor 22 produces a toner near-end signal due to the short supply of toner while the copier is operating with the toner cartridge 27 being loaded as shown in FIG. 7 and, therefore, being sensed by the sensor 60. Then, the toner near-end signal is fed to the controller or CPU 69, FIG. 10, together with a cartridge sense signal outputted by the microswitch 160. In response, the controller 69 causes the display 102 to provide the previously mentioned message "SUPPLY TONER" for urging one to replace the toner cartridge 27 and thereby supply fresh toner to the developing unit 13.

One removes the used toner cartridge 27 by the previously described procedure as instructed by the message on the display 102. Then, the microswitch 160 is turned off to indicate that the cartridge 27 has been removed. At this instant, the toner near-end sensor 22 continuously produces the toner near-end signal. The controller 69, therefore, controls the display 102 to inform the operator of the next job step, i.e., inserting a new toner cartridge by displaying a message such as "INSERT NEW CARTRIDGE". Watching this message, the operator inserts a new toner cartridge 27 to the deepest position, as stated earlier. The new cartridge 27 presses the lever 65 to move the end **60*a* of the latter away from the arm 60*a* of the microswitch 160. Consequently, the microswitch 160 is brought into the ON state to show that the new cartridge 27 has been loaded. Then, the display 102** informs the operator of the next job to be done by a message such as "PULL CARTRIDGE SHUTTER".

In order that the toner cartridge 27 may be surely sensed on reaching the predetermined position, it is preferable that the microswitch 160 senses the toner cartridge 27 when the latter is pushed to the deepest position. For this reason, in the illustrative embodiment, the microswitch 160 constituting the sensor 60 is mounted on the deepest portion of the cartridge cover 36A.

As the operator pulls the shutter 27A in the direction A as instructed by the message, the shutter sensor 61, FIG. 9, senses the opening of the shutter 27A resulting in the message "PULL CARTRIDGE SHUTTER" being turned off. At the same time, in the illustrative embodiment, a message for urging the operator to close the shutter 27A again appears on the display. A specific construction of the shutter sensor 61 will be described.

Referring to FIG. 9, a lever 71 is rotatable about a pin 72 which is studded on the outer end wall 70 of the toner hopper 36 in such a manner so as not to interfere with the inner cover 34, FIG. 6. A microswitch 161 constituting the sensor 61 and having an arm 76 is also mounted on the wall 70 of the tone hopper 36. A torsion coil spring 73 is wound around the pin 72 and is anchored at one end to the wall 70 and at the other end to the lever 71, whereby the lever 71 is constantly biased counterclockwise about the pin 72 as viewed in FIG. 9. A roller 74 is rotatably mounted on one end of the lever 71. By the force of the spring 73, the roller 74 is urged against a longitudinally extending side wall 75 of the shutter 27A (see FIG. 5). In this condition, the other end of the lever 71 is spaced apart from the arm 76 of the microswitch 160, maintaining the switch 161 in an OFF state. As shown in FIG. 5, a recess 76 is formed in the deepest portion of the side wall 75 of the shutter 27A for receiving the roller 74.

Assume that a new toner cartridge 27 has been loaded in the position shown in FIG. 7 and sensed by the cartridge sensor 60, but the shutter 27A has not been pulled out yet. In this condition, the roller 74 is held in contact with the side wall 75 of the shutter 27A, maintaining the microswitch 161 in an OFF state. As the operator pulls out the shutter 27A as instructed by the previously mentioned message, the recess 76 of the shutter side wall 75 approaches the roller 74 which is rolling on the side wall 75. As soon as the shutter 27A reaches the outermost or open position, the recess 76 mates with the roller 74 with the result that the lever 71 is rotated counterclockwise about the pin 72 as viewed in FIG. 9. Then, the other end of the lever 71 presses the arm 76 of the switch 161 to turn it on. This shows that the shutter 27A has been pulled out, i.e., it has been opened. In response to the resulting output of the switch 161, the controller 69 controls the display 102 to turn off the message "PULL CARTRIDGE SHUTTER" and, instead, produces a message such as "PUSH CARTRIDGE SHUTTER" for urging the operator to return the shutter 27A to the original position. Watching this message, the operator will push the shutter 27A to its deepest position.

It will be seen that the recess 76 of the shutter 27A constitutes a specific form of an actuator for actuating the shutter sensor (microswitch 161 in the illustrative embodiment) which is responsive to opening of the shutter 27A. Preferably, the recess 76 should be positioned relative to the switch 161 such that it actuates the switch 161 when the shutter 27A is fully pulled out. In this embodiment, therefore, the switch 161 and the recess 76 are located at the outermost position and the innermost position, respectively. If desired, the recess 76 may be replaced with a notch or a projection. Such an exclusive actuating portion may even be omitted if an arrangement is made to move the roller 74 and thereby operate the switch 161 when the side wall 75 of the shutter 27A moves away from the roller 74.

In the specific construction shown in FIG. 8, the stop 67 is provided integrally with the bracket 63 on which the switch 160 is mounted. The stop 67 serves to protect the arm **60*a* of the switch 160 from excessive loads otherwise exerted by the lever 65. Such a unitary configuration of the bracket 63, stop 67 and switch 60 makes it needless to adjust the relative position of the stop 67 and switch 60 and, therefore, promotes easy assembly. In FIG. 10, the reference numeral 170 designates a copy counter the output of which is also fed to the controller 69**.

The operation described above will be discussed more specifically with reference to FIGS. 11A and 11B.

Figure 11A:
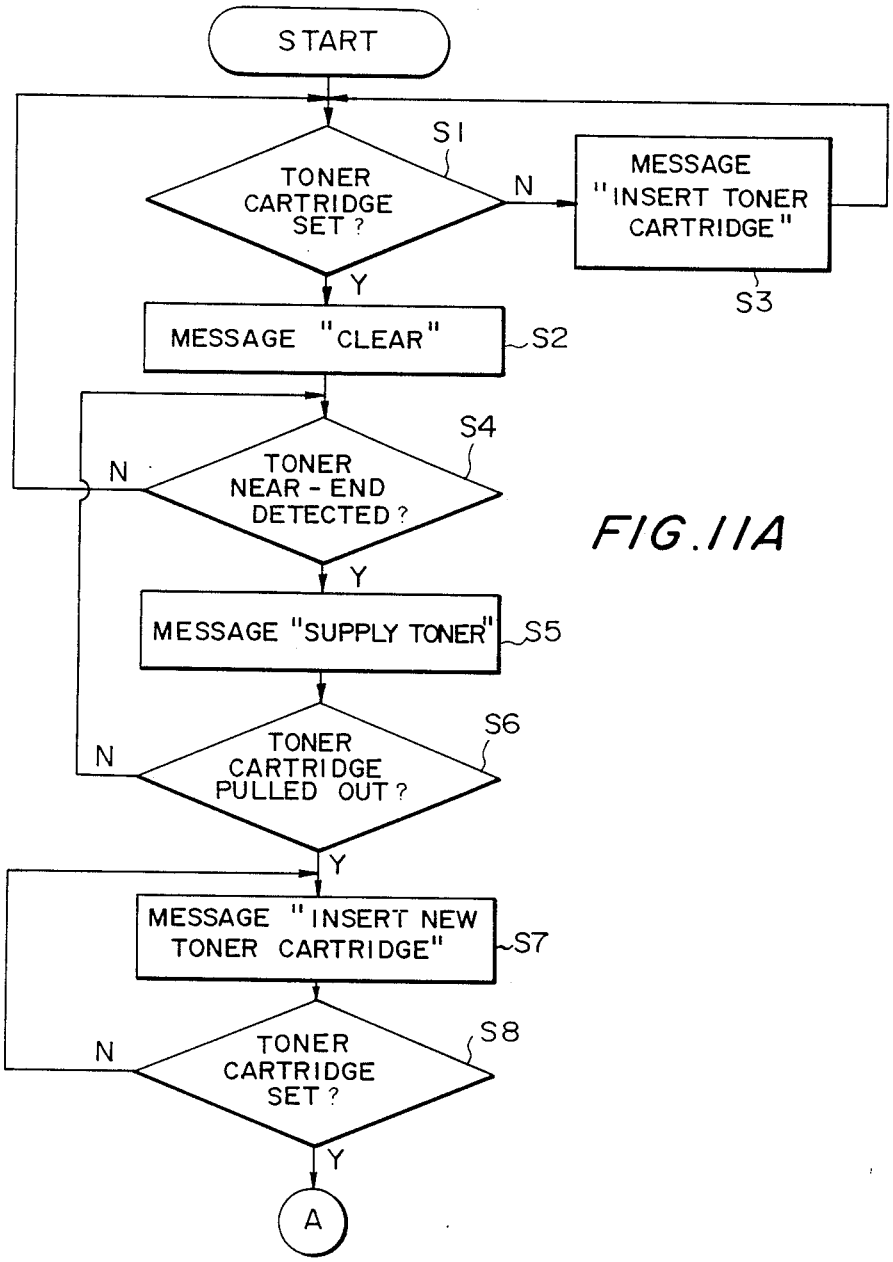
FIGS. 11A and 11B are flowcharts demonstrating specific operations associated with the supply of toner.
Figure 11B:
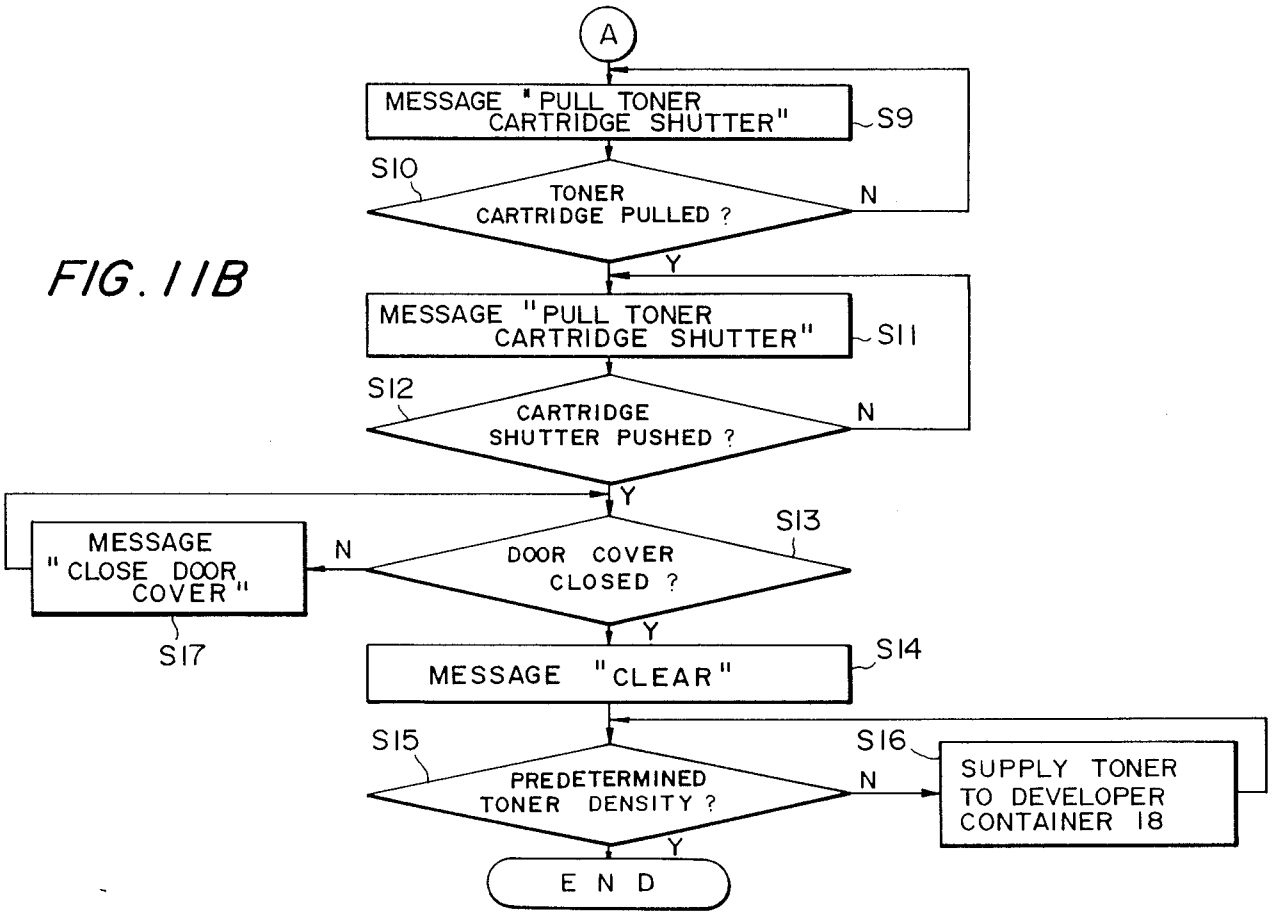

In FIG. 11A, whether or not the toner cartridge 27 is present in the copier is determined while the copier is in operation or in a standby condition (step S1). If the answer of the step S1 is YES as determined by the microswitch 160, the display 102 indicates no messages (step S2). If the answer of the step S1 is NO, meaning that the toner cartridge 27 has been removed, a message "INSERT TONER CARTRIDGE" appears (step S3). Should the copying operation be continued without loading the toner cartridge 27, the waste toner from the cleaning unit 20 would be introduced in the toner hopper 36 to degrade toner images. In the illustrative embodiment, when the toner cartridge 27 is absent, the controller 69 automatically disables the image forming apparatus 169, i.e., interrupts the copying operation when 500 more copies have been produced after the appearance of the message "INSERT TONER CARTRIDGE". Assume that the toner near-end sensor 22 has produced a toner near-end signal indicating that the amount of toner remaining in the toner hopper 36 is short (step S4). Then, a message "SUPPLY TONER" is displayed (step S5). In this embodiment, the amount of toner remaining in the developing unit 13 is sufficient to produce 3,000 more copies, and the copying operation is automatically interrupted when 3,000 more copies have been produced or when the toner concentration of the developer has continued to decrease, as stated earlier.

The step S5 is followed by a step S6 for determining whether or not the toner cartridge 27 has been removed. If the answer of the step S6 is YES as determined by the microswitch 160, a message "INSERT NEW TONER CARTRIDGE" appears (step S7). Then, whether or not a new toner cartridge has been loaded is determined (step S8). If the answer of the step S8 is NO, the copying operation is interrupted when 500 copies have been produced after the appearance of the above message.

Assume that a new toner cartridge 27 is loaded and sensed by the switch 160. Then, as shown in a step S9 of FIG. 11B, a message "PULL CARTRIDGE SHUTTER" appears. This is followed by determining whether or not the shutter 27A has been pulled out (step S10). If the answer of the step S10 is NO, the copying operation is interrupted when 500 more copies have been produced after the appearance of such a message so as to eliminate the undesirable occurrences as discussed earlier. If the answer of the step S10 is YES, a message "PUSH CARTRIDGE SHUTTER" indicative of the next step appears (step S11). Then, whether or not the shutter 27A has been pushed into the copier is determined (step S12). If the answer of the step S12 is NO, the copying operation is automatically interrupted when 500 more copies have been produced.

If the answer of the step S12 is YES as determined by the switch 161, whether or not the door cover 23, FIG. 2, is closed is determined (step S13). If the answer of the step S13 is NO, the message is cleared (step S14) and the toner concentration of the developer in the developing unit 18 is checked (step S15). If the toner concentration is equal to a predetermined concentration, the sequence of steps for toner supply is completed; if otherwise, the toner is supplied to the developing unit 18 (step S16). If the door cover 23 is open as decided in the step S13, a message for urging the operator to close it appears (step S17). It is to be noted that when the toner concentration of the developer is lowered during the above sequence and not restored within a predetermined period of time, the copying operation is stopped.

In the embodiment shown and described, it is when the amount of toner remaining in the toner hopper 36 is reduced that the toner near-end sensor 22 determines that the toner supply is short. Alternatively, a toner shortage sensor, one specific form of which is the near-end sensor 22, may be responsive to a condition wherein the amount of toner remaining in the toner hopper 36 is substantially zero.

In the illustrative embodiment, the toner from the toner supply chamber 21 is fed into the developer container 18, and the toner cartridge 27 is loaded in the toner hopper 36 to supply the toner into the chamber 21. The present invention is, of course, applicable to any other type of developing device such as a device wherein a toner cartridge is directly mounted in the developer container 18 to supply a toner into the container 18, or a device operable with a one-component developer which does not contain a carrier.

In summary, the present invention allows one to surely complete a sequence of steps for toner supply, i.e., from the removal of the used toner cartridge to the insertion of a new toner cartridge while watching instructions on a display.

Various modifications will become possible for those skilled in the art after receiving the teachings of the present disclosure without departing from the scope thereof.

What is claimed is:

1. An image forming apparatus for developing a latent image electrostatically formed on an image carrier by a developer in the form of a toner to produce a toner image, comprising:

a developing device loaded with a removable toner cartridge containing a toner therein and supplied with said toner from said toner cartridge, the toner cartridge comprising:

a body; and a shutter openably mounted on an opening which is formed through said body;

said shutter being opened to supply the toner into said developing device when a new toner cartridge is loaded in said developing device;

a shutter sensor responsive to opening of said shutter;

a sensing device responsive to a condition wherein the toner should be supplied to said developing device and to execution of consecutive manipulations for toner supply, said sensing device comprising:

a toner shortage sensor for sensing shortage of toner in said developing device; and a cartridge sensor for sensing the toner cartridge being loaded;

a controller for controlling said display such that when said toner shortage sensor has sensed a shortage of toner and said cartridge sensor has sensed presence of the toner cartridge, a message for urging one to supply the toner to said developing device by replacing said toner cartridge appears while, when said toner shortage sensor has sensed a shortage of toner and said cartridge sensor has sensed an absence of said toner cartridge, a message for urging one to insert a new toner cartridge appears; and a display for displaying, in response to an output signal of said sensing device, a kind of manipulation to be executed next.

2. A toner cartridge removably mounted on an image forming apparatus which develops a latent image electrostatically formed on an image carrier by a developer in the form of a toner for supplying said toner to said apparatus, comprising:

a body accommodating the toner; a shutter openably mounted on an opening which is formed through said body; and an actuator provided on said shutter for actuating a shutter sensor which is mounted on said image forming apparatus for sensing opening of said shutter.

3. A toner cartridge as claimed in claim 2, wherein said shutter is slidably mounted on said body and uncovers said opening of said body when pulled out.

4. An apparatus as claimed in claim 1, wherein said actuator is positioned relative to said shutter sensor such that said actuator actuates said shutter sensor when said shutter is retracted to a maximal position.

* * * * *